United States Patent [19]

Focke et al.

[11] 4,151,699

[45] May 1, 1979

[54] PRODUCTION OF DISCRETE BLANKS FOR PACKETS

[75] Inventors: Heinz H. Focke; Kurt W. Liedtke, both of Verden, Fed. Rep. of Germany

[73] Assignee: Focke & Pfuhl, Verden, Fed. Rep. of Germany

[21] Appl. No.: 700,949

[22] Filed: Jun. 29, 1976

[30] Foreign Application Priority Data

Jul. 11, 1975 [DE] Fed. Rep. of Germany ..... 2530992

[51] Int. Cl.[2] ..... B65B 11/16; B26D 7/06; B31B 1/16

[52] U.S. Cl. ..... 53/228; 53/389; 93/58.2 R; 83/920; 83/49; 83/100; 83/346; 83/408; 83/152

[58] Field of Search ..... 83/49, 920, 152, 100, 83/98, 162, 404, 408, 420, 346, 347, 343; 53/228, 389; 93/58.2 R, 58 R, 58.4

[56] References Cited

U.S. PATENT DOCUMENTS

| | | | |
|---|---|---|---|
| 1,487,662 | 3/1924 | Langston | 83/920 |
| 1,532,538 | 4/1925 | Langston | 83/920 |
| 3,399,587 | 9/1968 | Lee et al. | 83/152 |
| 3,982,375 | 9/1976 | Focke | 53/389 |

*Primary Examiner*—Donald R. Schran

*Attorney, Agent, or Firm*—Sughrue, Rothwell, Mion, Zinn and Macpeak

[57] ABSTRACT

A method of and apparatus for producing discrete blanks from a web of foil or the like lis provided, in which the foil or the like are given continuous constrained guidance during the phase between separation of the web until transfer to a packet or packing machine. Severance from the web is carried out in at least one initial cut, followed by a main cut, during continuous constrained guidance.

10 Claims, 9 Drawing Figures

PRODUCTION OF DISCRETE BLANKS FOR PACKETS

Figure 1:
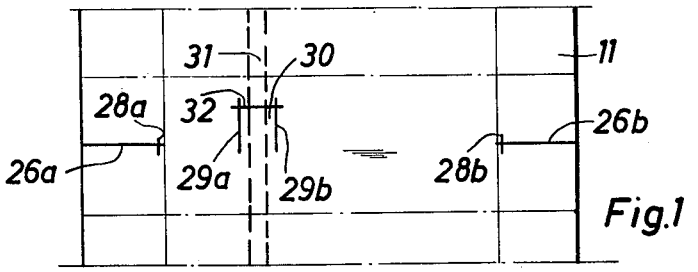

This invention relates to a system for producing discrete blanks severed from a continuously moving web, the web and the blank being guided during conveyance.

The invention is mainly concerned with the production and conveyance of blanks of a packaging material for wrapping discrete packets, in particular the production and conveyance of blanks of plastics material foils or sheets or the like which are difficult and delicate to control in mechanical processing.

Packets for cigarettes, and to some extent for cigarillos and the like, are so contrived that a hard box or soft packet which receives the cigarettes is externally surrounded by a protective wrapping made of a thin transparent blank. This outer wrapping has conventionally nearly always been made of transparent acrylic resin sheet. The packing industry has long been endeavouring to use other substances, for example plastics materials such as polypropylene, for packings of this kind, since foils made of the materials suggested have technical as well as economic advantages over acrylic resin sheet. Unfortunately, it has proved impossible to use plastics material foils so far since a web of the corresponding packing material, and the various blanks prepared from the web, cannot be given constrained guidance continuously and without interruption. In the conventional procedures and apparatus, the constrained guidance always has to be interrupted in the region where the necessary transverse severing cut must be made to sever the discrete blanks from the web; consequently, unwanted relative movements, creasing and so on are produced in the foils as they are being processed and make it impossible to supply the blank properly to the packet or to a packing machine.

It is an object of the invention to provide an apparatus whereby even highly sensitive foils or the like can be procesed because they are given continuous constrained guidance during a phase before separation from the web until transfer to a packet or packing machine.

According to the first aspect of the present invention there is provided a system for producing discrete blanks severed from a web, the web and the blank being guided during conveyance, in which severance is carried out in at least two partial cuts which amplify one another and which occur one after another and, at least during a main cut, which completely severs the blank, the web and/or the blanks are guided outside the region of the main cut and during further conveyance.

According to the second aspect of the present invention there is provided an apparatus for the production of blanks, more particularly for wrapping articles such as cigarette packets, by severance from a continuously moving web, the web and the blank being in contact with a guide during conveyance, which apparatus comprises means for effecting severance by making at least one initial cut and one main cut which amplifies the or each initial cut, the main cut being made in a conveying portion where there is continuous constrained guidance for the web and for the blanks outside guide elements which act on the web and/or the blanks in the region of the or each initial cut.

According to the invention, therefore, the blank is first partly severed from the web while remaining sufficiently connected thereto to ensure guidance. During further conveyance, the blank or a part of the web connected thereto is engaged and given constrained guidance in the zone of the partial cut just made, whereafter the blank is severed from the web completely by the main cut, the same being made in the zone outside the region in which the web and the blank are given constrained guidance. The severing cuts can, therefore, be made without any hindrance by guide elements, yet there is no interruption in the guide elements, nor in the constrained guidance provided thereby, during the complete severance of the blank from the web.

In the apparatus, the guide elements can conveniently take the form of perforated belts or tapes or the like which engage laterally with the web and/or blanks and which operate by means of suction. Correspondingly, initial cutting is carried out in two regions near lateral strips of the web—that is of the subsequent blanks—whereafter the main cut is made in the central region—that is outside the perforated box or the like—as an amplification of the initial cuts.

Figure 2:
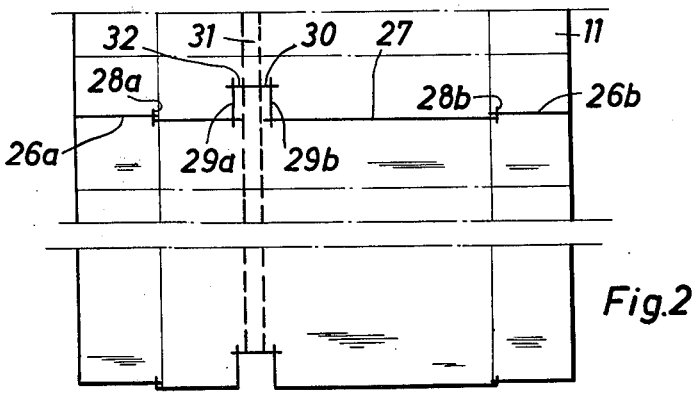
Figure 3:
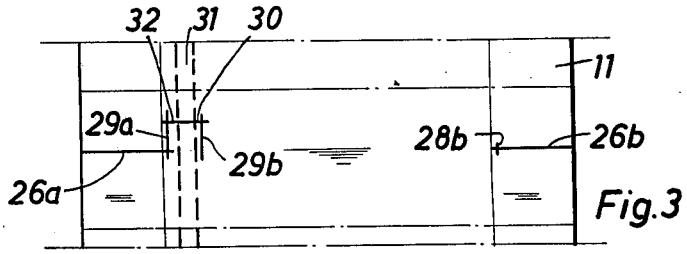
Figure 4:
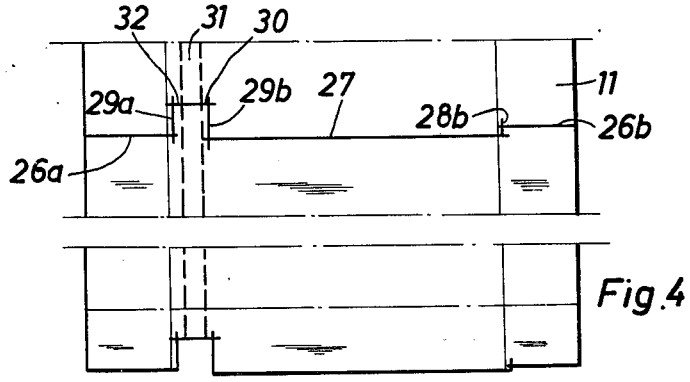
Figure 5:
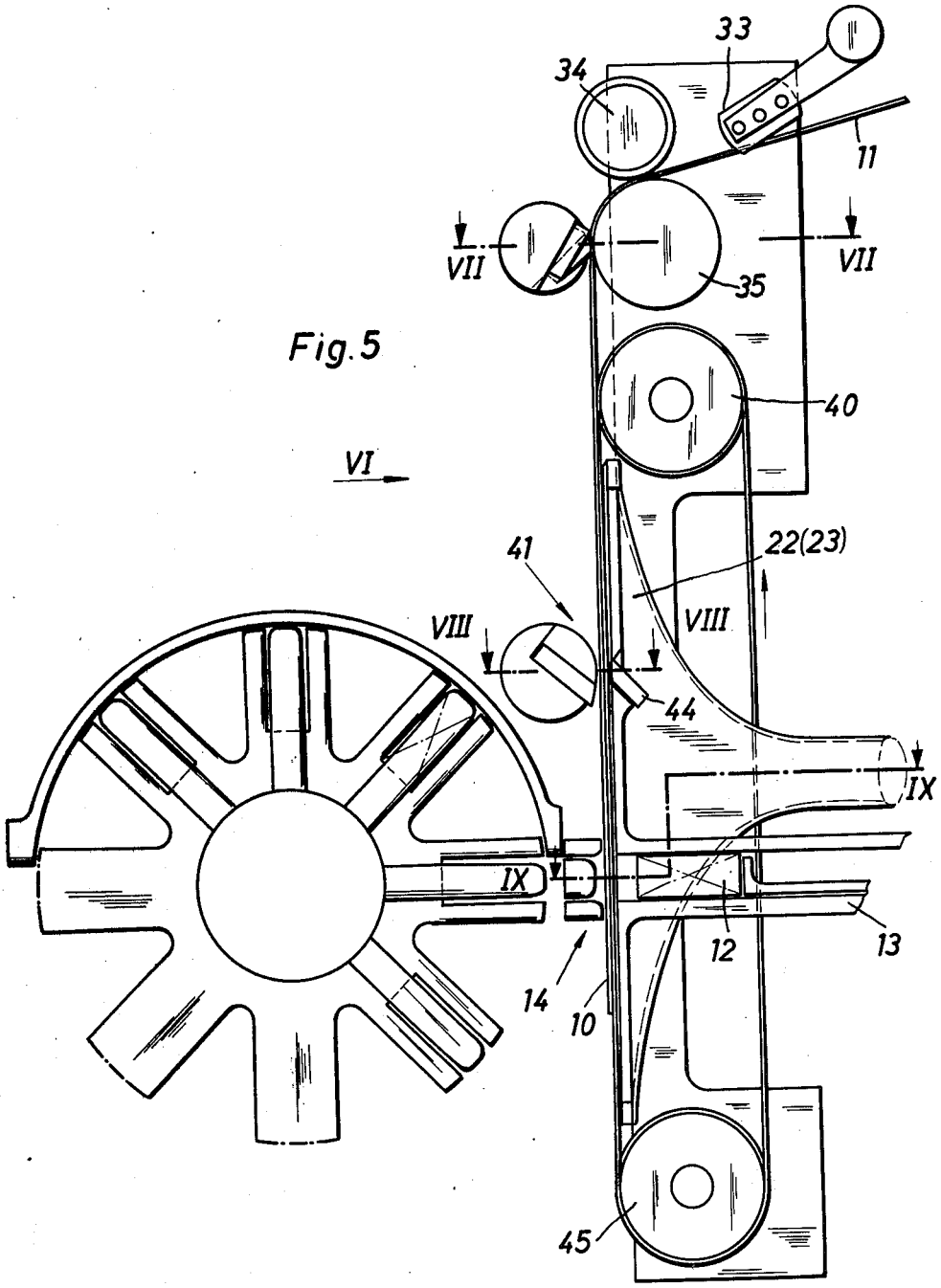
Figure 6:
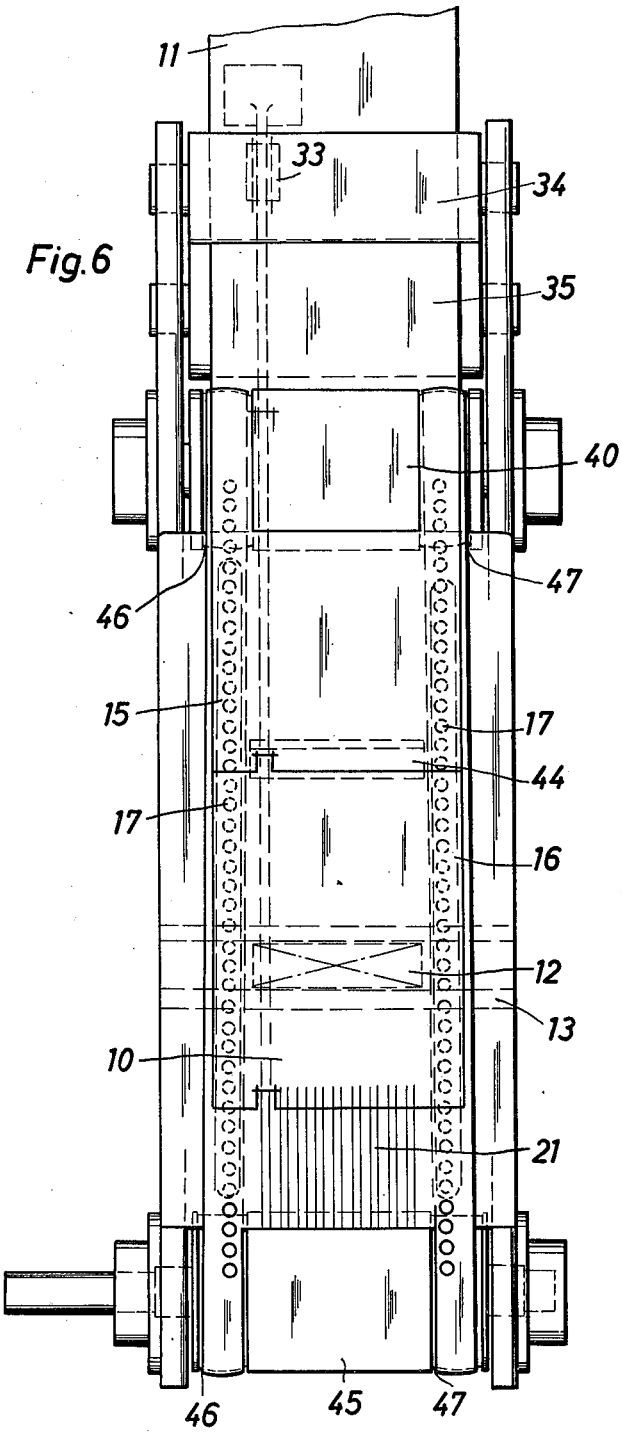
Figure 7:
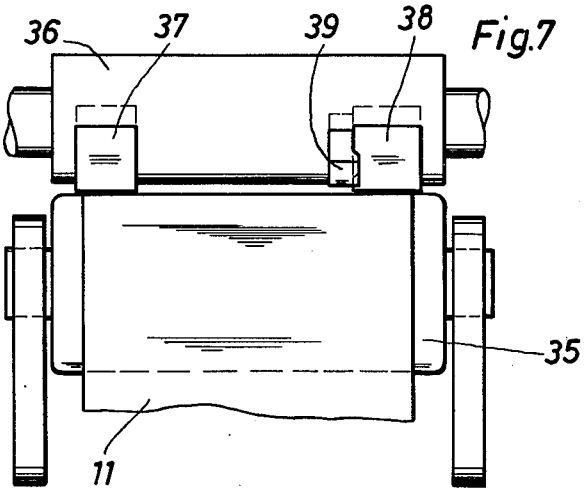
Figure 8:
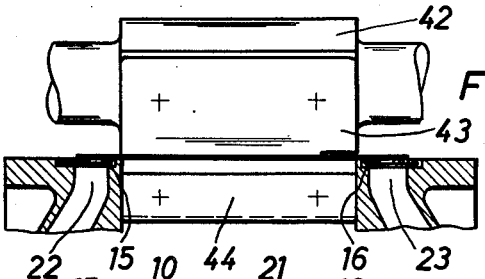
Figure 9:
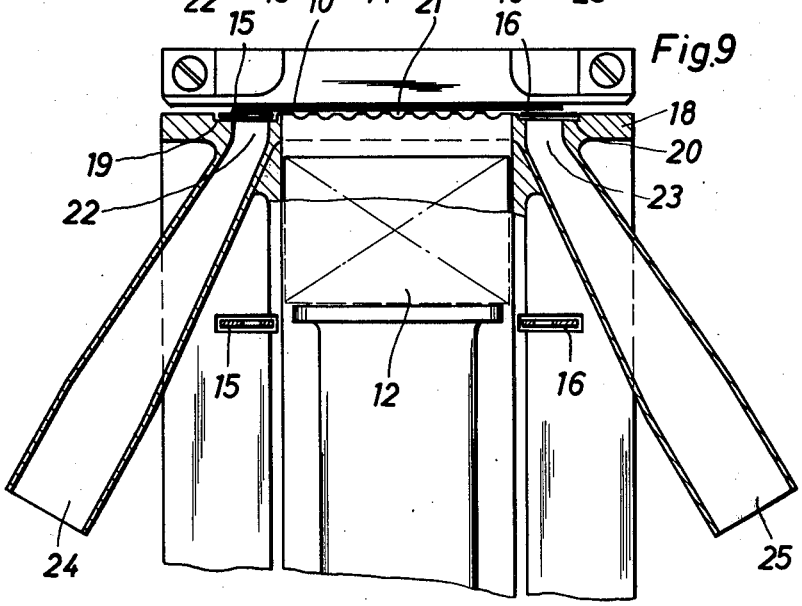

For a better understanding of the present invention and to show how the same may be carried into effect, reference will now be made, by way of example, to the accompanying drawings, in which FIG. 1 shows a plan view of a portion of a web of packing material in which an initial cut has been made, FIG. 2 shows a plan view of a blank which has been severed from the web by a main cut amplifying the initial cut, FIG. 3 shows a view similar to that of FIG. 1 of another embodiment, FIG. 4 shows a view of a blank which has been severed from the web in the manner shown in FIG. 3, FIG. 5 shows a diagrammatic side elevational view of an apparatus for producing and guiding blanks, FIG. 6 shows a sectional view of the apparatus of FIG. 5, in the direction indicated by an arrow VI, some parts of the apparatus not being shown for simplicity, FIG. 7 shows a sectional view on the line VII—VII of FIG. 5, FIG. 8 shows a detailed sectional view on the line VIII—VIII of FIG. 5, and FIG. 9 shows a sectional view on the line IX—IX of FIG. 5.

Referring now to the drawings, in the embodiment shown, discrete pack blanks 10 are parted off or severed from a continuously fed web 11. The web and blanks are made for example of plastics material. The blanks 10 are used to wrap oblong articles 12 such as cigarette packets. In the present case, the articles 12 are supplied on a horizontal packing path 13, the blanks 10 being conveyed transversely—that is perpendicularly—of the path 13. The packing operation operated is initiated in known manner by the article 12 being pushed through the plane of the blank 10—which has been made ready for this step—and subsequently taking the blank 10 with it, through a folding orifice 14, the blank 10 engaging around the article 12 to some extent.

It is required so to guide the blanks 10 and the arriving web 11 that continuous constrained guidance is ensured overall—that is until a blank is transferred to the article 12 to be packed.

In the system according to this invention, the blank, while in engagement with the web 11 to a considerable extent—that is to an extent sufficient for constrained guidance—is received by guiding and conveying elements embodied by narrow lateral moving perforated belts or bands or the like 15 and 16, in the form of high-tensile (metal or textile) belts formed throughout at reduced intervals with suction orifices 17. The suction orifices, and therefore the belts 15 and 16, are associated with suction air or a negative pressure at least over a part of the run near the blank 10 and/or web 11. Consequently, the web zones associated with the belts 15 and 16, and the blank 10, are located on and conveyed by the belts 15 and 16. This constrained guidance region of the blank 10 and web 11 extends to the other side—that is, to below the packing path 13—so that the blank 11 which has been prepared for entrainment by an article 12 has been located at its full length on both sides of the orifice 14.

The belts 15 and 16, —that is their respective run which is near the blank 10—travel near a vertical support plate 18 extending laterally beyond the belts 15, 16. The support surface which is near the blank 10 and/or web 11 is flush with the outside surface of the belts 15 and 16. To this end, the same run is appropriately dimensioned with shallow grooves 19 and 20 in the plate 18. The support plate zone, which extends between the belts 15 and 16, is formed with vertical grooves 21 which serve as an air gap between, on the one hand, the web 11 and/or blank 10 and, on the other hand, the plate 18.

The belts 15 and 16 are formed, on the back of the zones near the blank 10 and/or web 11, with narrow vertical suction nozzles 22 and 23. Connected to each thereof is a respective central suction line 24, 23 which extend to a source of negative pressure, such as a fan. Due to the trumpet shape of the nozzles 22 and 23 and/or suction lines 24 and 25, a substantially uniform negative pressure is operative on the back of the belts 15 and 16 over the whole length of the nozzles 22 and 23. As can be seen from the drawings, the belts 15 and 16 pass very close to the nozzles 22 and 23 (see FIGS. 8 and 9).

A special feature of the invention is the severance of the blanks 10 from the web 11 without interruption of the necessary constrained guidance. To this end, a partial cut, in the form of an initial or preliminary cut, is made in the web 11 before the same enters the constrained-guidance zone provided by the belts 15 and 16, whereafter a main cut for completely severing the blank from the web is made in the region of the belts 15 and 16. FIG. 1 shows a portion of the web 11 in which lateral initial or preliminary cuts **26*a* and 26*b* have been made. The initial cuts are so devised as to leave an adequate connection for web guidance between the web and the subsequent blank but to be of sufficient width to enable the belts 15 and 16 to engage. The belts 15 and 16 subsequently engage with the web 11 and/or blank 10 in the region of the initial cuts 26*a* and 26*b***.

The main cut 27 is made as an amplification of the initial cuts **26*a* and 26*b* in the region of conveyance by the belts 15 and 16**—that is, therebetween.

Starting from the initial cuts **26*a* and 26*b*, longitudinal cuts are made in the web 11, namely equalizing or compensating cuts 28*a* and 28*b* near the junctions between the initial cuts 26*a* and 26*b*, on the one hand, and the main cut 27, on the other hand. The equalizing cuts 28*a* and 28*b* ensure complete severance of the blank from the web 11 even though, as a result of often unavoidable measurement tolerances, the main cut 27 is not exactly in prolongation of the initial cuts 26*a* and 26*b*** but is slightly offset therefrom.

In the present case, longitudinal cuts **29*a* and 29*b* for delineating a tab 30—often found in such blanks—of a tear-off strip 31 are contrived simultaneously with the equalizing or compensating cuts 28*a* and 28*b*. A cross-cut 32, required to complete the tab 30, is made together with the initial or preliminary cuts 26*a* and 26*b***.

The embodiments shown, on the one hand, in FIGS. 1 and 2 and, on the other hand, in FIGS. 3 and 4, are based on the same underlying principle as one another but differ as regards the relative position of the tab 30. FIGS. 1 and 2 show a version for hard box packets, whereas the embodiment shown in FIGS. 3 and 4 is for soft packets. In the case of FIGS. 1 and 2, the tab 30 is disposed at a distance from the ends of the initial cuts **26*a* and 26*b*. The main cut 27 is correspondingly subdivided into two cuts following on from the longitudinal cuts 29*a* and 29*b*. In the embodiment shown in FIGS. 3 and 4, the tab 30 follows on directly from the initial cut 26*a* and the continuous main cut 27 terminates at the longitudinal cut 29*b* of the tab 30**.

The various cuts are made by appropriate parting-off or cutting facilities. The longitudinal cuts **28*a*, 28*b*, 29*a* and 29*b* are made by pivoted blades 33 which cut into the web 11 for a time depending on the length of the particular cuts concerned. The blades 30 are disposed before a pair of pulling rollers 34 and 35 as considered in the direction of conveyance. Roller 35 is also the back-up roller for blades for producing the initial cuts 26*a* and 26*b* and the cross-cut 32 of the tab 30. For each of these transversely directed cuts there is one knife 37 or 38 for the initial cuts 26*a* and 26*b* and another knife 39, which is staggered relative to the other knives and which serves for the cross-cut 32, the knives being mounted on a common knife or blade roller 36. As considered in the direction of conveyance, the severing or parting-off facility, which has just been described and which is shown in FIG. 7 is disposed before the constrained-guidance zone—that is, before a (top) reversing roller 40 for the belts 15 and 16**.

A parting-off facility 41 which makes the main cut 27 is disposed near the constrained-guidance zone—that is at an adequate distance from the reversing roller 40. As can be seen from FIG. 8, the facility 41 comprises a knife or blade roller 42 on which a knife 43 is mounted. Knife rollers 36 and 42 are rotated to make the cuts. On the side opposite to the roller 42, a stationary back-up or matching knife 44 is disposed in the support plate 18. Complete severance of the blank 10 from the web 11 occurs only after the facility 41 has passed by.

At the end opposite to the roller 40, the belts 15 and 16 run around a corresponding reversing roller 45. The two rollers 40 and 45 are formed with lateral grooves 46 and 47; conveniently, the grooves 46 and 47 of the bottom roller 45 are further apart from one another than are the grooves of the top roller 40. The belts 15 and 16, therefore, diverge slightly from one another in their movement, with the result that the web 11 and/or blank 10 experiences a smoothing and slightly tensioning spreading effect. The support surfaces for the belts 15 and 16 near the grooves 46 and 47 are spherical.

What is claimed is:

1. Apparatus for the production of packaging blanks cut from thin, highly flexible material supplied in a continuous web, comprising in combination:

first and second continuous revolving transporting members, said transporting members each comprising means for grasping side portions of said web to provide support for said web;

first separating knives disposed adjacent said web at a position before said web is grasped by said transporting members, said separating knives making preliminary cuts at predetermined intervals along said web through said side portions corresponding at least to said transporting members; and second separating knives disposed between portions of said transporting members, said second knives making main cuts for separating said blanks from said web, said main cuts extending at least between said preliminary cuts.

2. Apparatus as in claim 1, wherein said transporting members comprise laterally running conveyer belts.

3. Apparatus as in claim 2, wherein said laterally running conveyer belts are perforated, and said grasping means comprises means for applying a retaining force of suction air to said belts to retain said web and said blank.

4. Apparatus as in claim 3, wherein said means for applying a retaining force comprises an elongated narrow suction nozzle means extending beyond the distance of guidance and transportation, said nozzle means comprising two nozzles, one corresponding to each of said belts and which act upon the belts with suction air on the side opposite the web or blank.

5. Apparatus as in claim 2, further comprising means for divergingly guiding said belts in the direction of conveyance.

6. Apparatus as in claim 5, wherein said guiding means comprises reversing rolls, said reversing rolls having recesses for the reception of the belts, whereby the reces in one reversing roll lies forward in the direction of conveyance and having a larger distance from the recesses of the other reversing roll.

7. Apparatus as in claim 6 further comprising a supporting plate placed in at least the area between the belts for supporting the web and the blank and lying closely adjacent said belts.

8. Apparatus as in claim 7, wherein said supporting plate is provided with grooves, said grooves running in the direction of transportation on the side facing the blanks or the web.

9. Apparatus as in claim 7, wherein said supporting plate extends laterally beyond said belts and whereby said belts run in a fitting flat grooves of the supporting plate.

10. Apparatus as in claim 9, further comprising:

means for transporting articles to be wrapped towards the cut blanks; and means for wrapping said articles with said blanks.

* * * * *